US011752722B2

(12) United States Patent
De Boer et al.

(10) Patent No.: US 11,752,722 B2
(45) Date of Patent: Sep. 12, 2023

(54) APPARATUS AND METHOD FOR CREATING ON DEMAND CUSTOMIZED CORRUGATED CARDBOARD FOR FORMING INDIVIDUALLY DESIGNED PACKAGING BOXES

(71) Applicant: Sparck Technologies B.V., Drachten (NL)

(72) Inventors: Fokke De Boer, Drachten (NL); Marco Polet, Drachten (NL)

(73) Assignee: Sparck Technologies B.V., Drachten (NL)

( * ) Notice: Subject to any disclaimer, the term of this patent is extended or adjusted under 35 U.S.C. 154(b) by 265 days.

(21) Appl. No.: 15/879,197

(22) Filed: Jan. 24, 2018

(65) Prior Publication Data

US 2018/0215117 A1 Aug. 2, 2018

(30) Foreign Application Priority Data

Jan. 31, 2017 (EP) ..... 17154070

(51) Int. Cl.
*B31B 50/00* (2017.01)
*B65B 61/02* (2006.01)
(Continued)

(52) U.S. Cl.
CPC ..... *B31B 50/006* (2017.08); *B31B 50/88* (2017.08); *B31F 1/28* (2013.01); *B31F 1/2822* (2013.01);
(Continued)

(58) Field of Classification Search
CPC ... B31B 50/006; B31B 50/88; B31B 2120/30; B31B 2100/0022; B31B 2120/302;
(Continued)

(56) References Cited

U.S. PATENT DOCUMENTS 3,155,234 A * 11/1964 Knoll ..... B65D 75/545 229/921
4,314,868 A * 2/1982 Hirakawa ..... B31F 1/2886 156/207
(Continued)

FOREIGN PATENT DOCUMENTS

| | | | |
|---|---|---|---|
| EP | 3 050 809 | A1 | 8/2016 |
| WO | 2014/119439 | A1 | 8/2014 |
| WO | 2014/188010 | A2 | 11/2014 |

OTHER PUBLICATIONS

Extended European Search Report, dated Aug. 21, 2017, for European Application No. 17154070,1-1708, 6 pages.
(Continued)

*Primary Examiner* — Sameh Tawfik
(74) *Attorney, Agent, or Firm* — Cozen O'Connor

(57) ABSTRACT

Apparatus to create on demand customized cardboard for forming individually designed packaging boxes, said cardboard having at least one corrugated layer sandwiched between two flat layers, the apparatus comprising a joining station that attaches a second flat layer to a corrugated layer attached to a first layer, supply system to supply said corrugated layer with the first flat layer attached thereto to said joining station, supply system to supply said second flat layer to said joining station, a control system operable to obtain information on the dimensions of a packaging box to be formed and on a design selected for that box and further operable to match the selected design to the dimensions of the box and a printing unit to print the matched design on the first and/or on the second flat layer.

9 Claims, 6 Drawing Sheets

(51) Int. Cl.

| | |
|---|---|
| ***B41J 13/00*** | (2006.01) |
| ***B31F 1/28*** | (2006.01) |
| ***B65B 59/00*** | (2006.01) |
| ***B31B 50/88*** | (2017.01) |
| *B31B 100/00* | (2017.01) |
| *B31B 110/35* | (2017.01) |
| *B31B 120/30* | (2017.01) |
| *B31B 120/70* | (2017.01) |

(52) U.S. Cl.
CPC ..... *B41J 13/0063* (2013.01); *B65B 59/001* (2019.05); *B65B 59/003* (2019.05); *B65B 61/025* (2013.01); *B31B 2100/0022* (2017.08); *B31B 2110/35* (2017.08); *B31B 2120/30* (2017.08); *B31B 2120/302* (2017.08); *B31B 2120/70* (2017.08); *B65B 2210/04* (2013.01)

(58) Field of Classification Search
CPC ... B31B 2110/35; B31B 2120/70; B31F 1/28; B31F 1/2822; B41J 13/0063; B65B 59/00; B65B 61/025; B65B 2210/04
USPC ..... 493/55
See application file for complete search history.

(56) References Cited

U.S. PATENT DOCUMENTS 6,090,027 A * 7/2000 Brinkman ..... B65B 5/02 156/DIG. 4
6,117,061 A * 9/2000 Popat ..... B31B 50/88 493/356
6,598,783 B2 * 7/2003 Brinkman ..... B65B 5/02 229/921
7,055,350 B2 * 6/2006 Bonnain ..... B65B 59/00 70/97
7,142,324 B2 * 11/2006 Haines ..... G06K 19/06028 399/389
7,530,210 B2 * 5/2009 McGuinness, Jr. ..... B65B 67/08 53/411
8,419,601 B2 * 4/2013 Harrington ..... G09F 3/02 493/53
9,493,024 B2 * 11/2016 Gombert ..... B42D 15/008
9,501,958 B2 * 11/2016 Pietarinen ..... G09F 3/0292
9,654,666 B1 * 5/2017 Snowball ..... H04N 1/3877
10,118,723 B2 * 11/2018 Clark ..... B65B 59/00
10,287,047 B2 * 5/2019 Zeilstra ..... B65B 5/06
10,402,890 B2 * 9/2019 Pettersson ..... B65B 59/00
10,452,789 B2 * 10/2019 Madmony ..... G06F 16/5854
10,521,741 B2 * 12/2019 Harnesk ..... G06Q 10/0631
2007/0175350 A1 8/2007 Crum
2008/0020916 A1 * 1/2008 Magnell ..... B65B 5/02 493/65
2012/0259687 A1 * 10/2012 Kajamohideen ... G06Q 30/0601 705/14.23
2013/0029825 A1 * 1/2013 Rich ..... B41J 3/543 493/324
2013/0232921 A1 * 9/2013 Sankaran ..... B65B 61/20 53/473

OTHER PUBLICATIONS

European Office Action for EP 17154070.1, dated Sep. 15, 2020, 6 pages.

* cited by examiner

APPARATUS AND METHOD FOR CREATING ON DEMAND CUSTOMIZED CORRUGATED CARDBOARD FOR FORMING INDIVIDUALLY DESIGNED PACKAGING BOXES

TECHNICAL FIELD OF THE INVENTION

The invention relates to an apparatus and a method for creating on demand customized corrugated cardboard for forming individually designed packaging boxes in particular on the site of systems for automatically packaging items to be shipped, said corrugated cardboard having at least one corrugated layer between two flat layers. The invention also relates to a system and a method for automatically forming packaging boxes using said apparatus respectively said method.

BACKGROUND OF THE INVENTION

In recent years, mail ordering has become increasingly common. In order to cope with the increased need for packaging mail ordered items, different systems and methods for automatically forming packaging boxes have been proposed.

US 2008/0020916 A1 discloses a box-making machine, which executes creasing and cutting steps to obtain a cardboard blank, which is then folded to obtain a packaging box from the blank. The invention may be advantageously used in this type and similar types of machines.

For making cardboard blanks to be used in box-making machines, usually a long web of cardboard is fed to such machine either from a roll of corrugated cardboard or from a stack, in which the web is zigzag folded into panels. Corrugated cardboard from a roll is flexible in one direction, as it comprises only one flat layer to which a corrugated layer is attached. Such type of corrugated cardboard is often called "single-faced". Without special measures or treatment, it is not well suited for making packaging boxes.

For making packing packaging boxes, so-called "standard" corrugated cardboard, which is rather stiff as it comprises a corrugated layer sandwiched between to flat layers, is preferred. However, such cardboard cannot be stored on a roll and hence is usually provided in form of a stack of zigzag folded panels.

Zigzag folded cardboard has the disadvantage that there are transversal folds in the source material at the positions where the panels are connected. These folds are usually not at positions where folds are needed in a blank that is to be cut from the source material. This is especially the case, when the sizes of the blanks to be cut vary while the panels in a stack of cardboard have a fixed size.

Avoiding that a fold in the source material will appear in the blank limits the maximum blank size (namely to the distance between two folds), and causes an undesired amount of waste material. When such folds are present in a blank that is used to fold a packaging such as a box, there is a risk that the blank will not be folded at the intended crease lines, but at the folds that are already present in the source material. This may cause undesired effects during or after the fold process and may cause crashes and/or damage to the packaging and/or articles being packed or result in an undesired appearance of the packaging and/or insufficient protection of the articles inside the packaging.

WO 2014/188010 A1 proposes an apparatus and a method that allow rigidifying cardboard having at least one fold and obtaining packaging material with increased stiffness from a cardboard stack that is formed by zigzag folding a cardboard web into panels connected via transverse folds, by applying creasing means to form in particular line-shaped indentations on at least one side of said cardboard, wherein at least some of said indentations intersect said at least one fold. This apparatus and method advantageously improve the production of cardboard boxes using cardboard from a stack of a zigzag folded cardboard web with transverse folds in respect of preciseness and/or stability of the cardboard boxes.

However, while the apparatus and method disclosed in WO 2014/188010 A1 work perfectly well in many cases, just forming indentions that intersect the unwanted folds may not in all cases lead to sufficient stiffness, in particular when rather thin material is used and/or the formed boxes are rather big and/or items to be packaged in said boxes are rather heavy.

WO 2014 119439 A1 discloses different methods for creating said standard corrugated cardboard (cardboard having at least one corrugated layer sandwiched between two flat layers) on the site of a system for automatically forming packaging boxes. According to one of the methods, single-faced corrugated cardboard from a roll is provided and a second flat layer is glued to it. Another method comprises forming a corrugated layer on-site and gluing two flat layers onto opposite sides of the thus created corrugated layer. However, it has turned out in practice that the gluing unit needed for applying glue to the respective layers on-site is rather complex, costly and requires a lot of maintenance.

WO 2014 119439 A1 also discloses a method of forming so-called "double corrugated" cardboard, in which the corrugated sides of two single-faced corrugated cardboards are brought into engagement with each other with little or no glue. However, it has turned out that without glue the cohesion between the two single-faced cardboards is not sufficient. Moreover, double-corrugated cardboard with two corrugated layers means using a lot of material, which not only increases costs and weight of the packaging boxes formed therefrom, but also increases waste.

In order to advantageously allow creating cardboard on the site, where the cardboard is needed, in particular on the site of a system for automatically forming packaging boxes, EP 3 050 809 A1, the disclosure of which is fully incorporated herein by reference, discloses a method and an apparatus, in which a corrugated layer attached to a first flat layer and a second flat layer are attached to each other such that the corrugated layer is sandwiched between the first and the second flat layers. Creation of the cardboard can advantageously be done directly on the site of a system for automatically forming packaging boxes from the cardboard created, allowing use of materials stored on rolls and avoiding unwanted folds in the cardboard.

In order to allow further customization of the cardboard, EP 3 050 809 A1 allows the operator to choose between different second flat layers with different printings on it. This can advantageously be used in so-called "drop shipment", in which the operator of a warehouse sends out packages in the name of different customers, the packages created on-site with the second layer bearing for example the name or logo of the respective customer.

US 2013 0 029 825 A1 discloses a system and a method for customizing cardboard by printing different designs onto it.

DISCLOSURE OF THE INVENTION

While the method and the apparatus disclosed in EP 3 050 809 A1 work perfectly well for numerous cases, the design of the cardboard is still limited, as only a limited number of different second flat layers could reasonably be held ready for creating cardboard on-site. Moreover, even keeping two or three rolls of different second flat layers ready on-site of an apparatus for creating cardboard increases the complexity and dimensions of the apparatus noticeably. As the second flat layers are pre-designed, additional logistic effort and advance-planning is needed, as on one hand sufficient stock of a certain design has to be kept ready for example in case of drop-shipment, in which the customer wants boxes with his particular design, while on the other hand the number of boxes to be created with a particular design may vary a lot over the year depending on the nature of the business of the respective customer. Hence, there is a need for allowing creation of individually designed corrugated cardboard on demand, avoiding the necessity to keep pre-designed layers on stock, and it is an object of the invention to disclose an apparatus and a method that allow creating cardboard that is customized in its design for creating an individual box.

The object is achieved by a method according to claim 1 respectively by an apparatus according to claim 10. Advantageous embodiments and implementations are subject to the respective dependent claims. Independent claim 12 is directed to a system for automatically forming packaging boxes comprising an apparatus according to the invention for creating customized cardboard. Such system will typically comprise numerous stations like a station for cutting out blanks, which may be customized individually, a station for providing a blank with crease lines and a station for folding a box from said blank. Independent claim 13 is directed to a method for automatically forming packaging boxes from cardboard comprising the acts of a method for creating customized cardboard according to the invention.

Further objects, features and advantages of the various embodiments of the invention will become apparent from the following non-limiting description of preferred embodiments in conjunction with the accompanying drawings.

DESCRIPTION OF PREFERRED EMBODIMENTS

Figure 1:
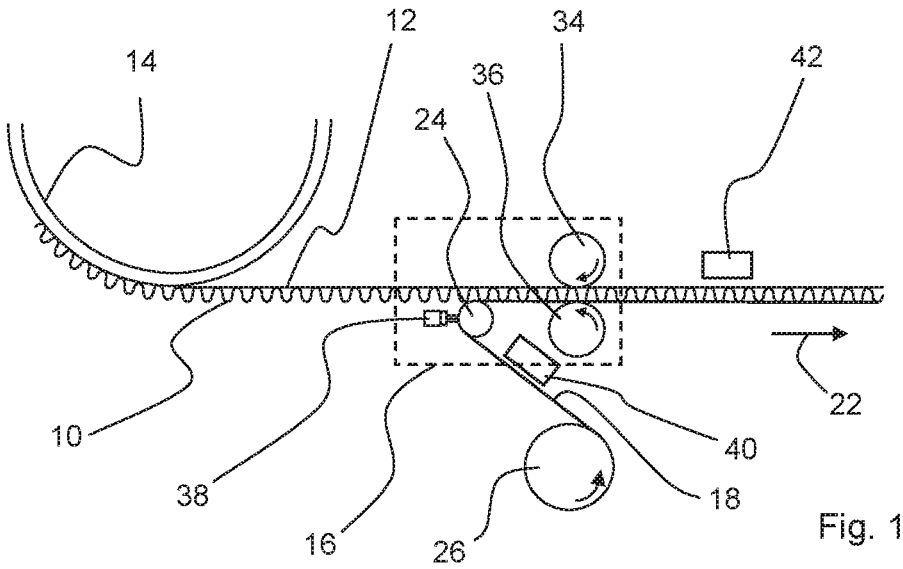
FIG. 1 shows very schematically a first embodiment of the invention.

In FIGS. 1 to 4, different embodiments of an apparatus according to the various embodiments of the invention for creating customized corrugated cardboard on demand are shown, the shown apparatus being adapted for working on-site of a system for automatically forming packaging boxes, said corrugated cardboard having at least one corrugated layer sandwiched between two flat layers, are shown very schematically.

Each apparatus comprises means for supplying single-faced corrugated cardboard, i.e., a corrugated layer 10 attached to a first flat layer 12, from a roll 14, which is shown only partially, to a joining station 16, where a second flat layer 18 is attached to the corrugated layer 10 to form standard corrugated cardboard 20 having a corrugated layer sandwiched between two flat layers. This cardboard can then be fed into a machine for automatically forming packaging boxes. Arrow 22 indicates the direction, in which the cardboard moves through the apparatus. For sake of clarity and in order to avoid overloading the drawings, the respective components are not in all drawings provided with respective reference numbers.

As will be described later, joining station 16 may comprise one or more pressing and transporting rollers 34, 36 and one or more transporting rollers 24 and other units for attaching the second flat layer 18 to the corrugated layer 10. The second flat layer 18 is supplied from a roll 26 to the joining station 16 with the aid of corresponding supply structure (e.g., driven and un-driven rollers).

The embodiment according to FIG. 1 comprises a so-called activation unit 38, which in this embodiment is used to make the side of the second flat layer 18 facing the corrugated layer 10 sticky. This can be done in multiple ways, for example by spraying liquid glue onto the respective side of the second flat layer, applying hot-melt glue to it or by activating (e.g., wetting) an adhesive substance that has already been applied to the respective side of the second flat layer prior to winding it up on the roll 26. While in the shown embodiment the side of the second flat layer facing the corrugated layer is made sticky, it is obvious for an expert in the art that likewise the side of the corrugated layer facing the second flat layer may be made sticky by activating an adhesive substance already provided on the corrugated layer or by applying an adhesive to it. Also, it is possible that both, the corrugated layer and the second flat layer, carry on the sides facing each other one component of a two-component adhesive, such that the layers stick to each other when brought into contact.

Figure 2:
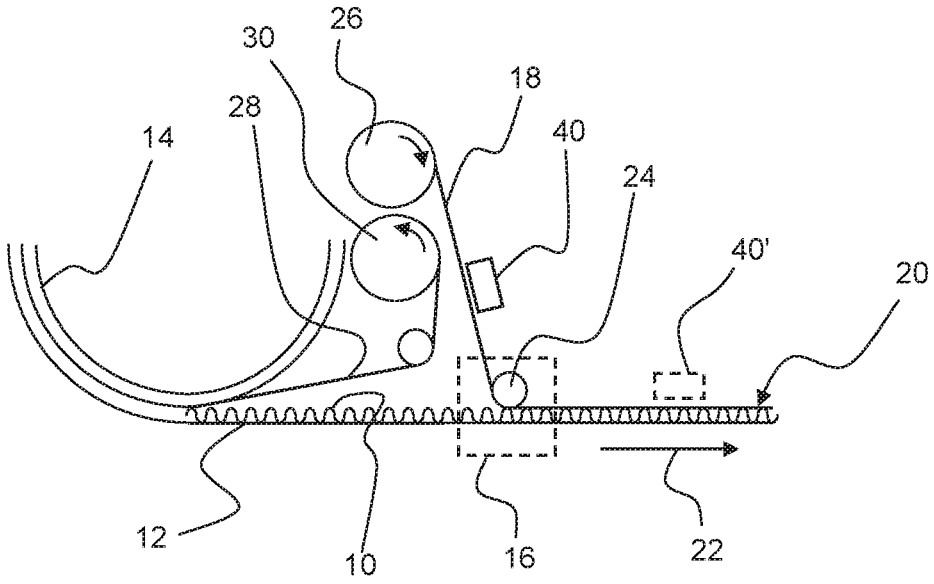
FIG. 2 shows very schematically a second embodiment of the invention.

In the embodiment shown in FIG. 2, the adhesive substance is provided on the corrugated layer 10 and is of the so-called self-adhesive type used for example for self-adhesive stickers. Obviously, it is sufficient to provide the adhesive substance only on the areas of the crests of the corrugated layer 10, as only those areas will come into contact with the second flat layer 18. In order to facilitate that the single-faced cardboard can be coiled up on roll 14 while preventing that upon coiling-up the side of the corrugated layer 10 provided with the adhesive substance sticks to the first flat layer, a protective layer (e.g., release liner) 28 covering the adhesive substance is provided on the corrugated layer and is removed prior to attaching the second flat layer 18 to the corrugated layer 10. The protective layer 28 is wound up on a roll 30 and may then be re-used.

Figure 3:
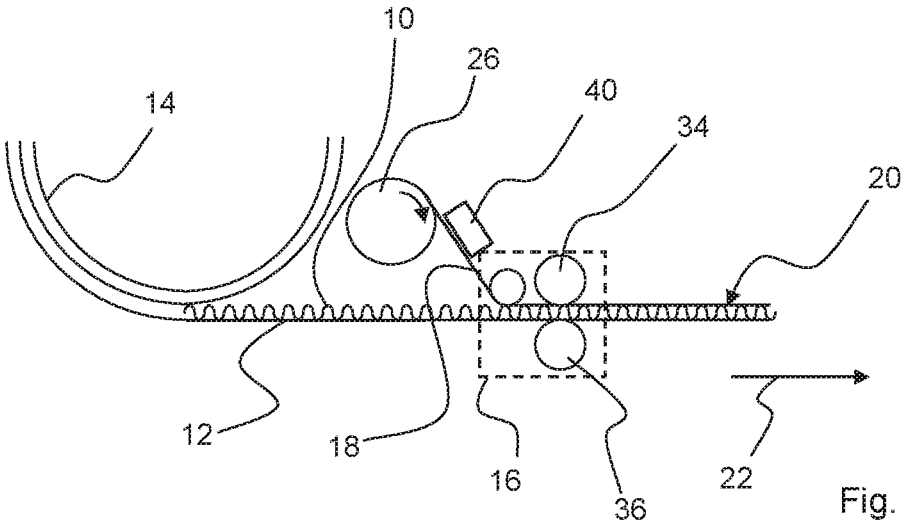
FIG. 3 shows very schematically a third embodiment of the invention.

FIG. 3 shows an apparatus, in which the joining station 16 comprises a pair of pressing rollers 34 and 36. This apparatus is used when a specific type of adhesive substance (e.g. so-called "cold seal") that only sticks to itself has been applied to both, the corrugated layer 10 and the second flat layer 18. Both, the single-face corrugated board, i.e. the corrugated layer 10 with the first flat layer 12 attached to it, and the second flat layer 18 can be stored on a respective roll 14 resp. 26. Only when the layers 10 and 18 are pressed together they will stick together and compose standard corrugated cardboard. No activation or peeling off is needed, but after merging the layers some pressure must be applied to ensure that the layers stick together properly.

Figure 4:
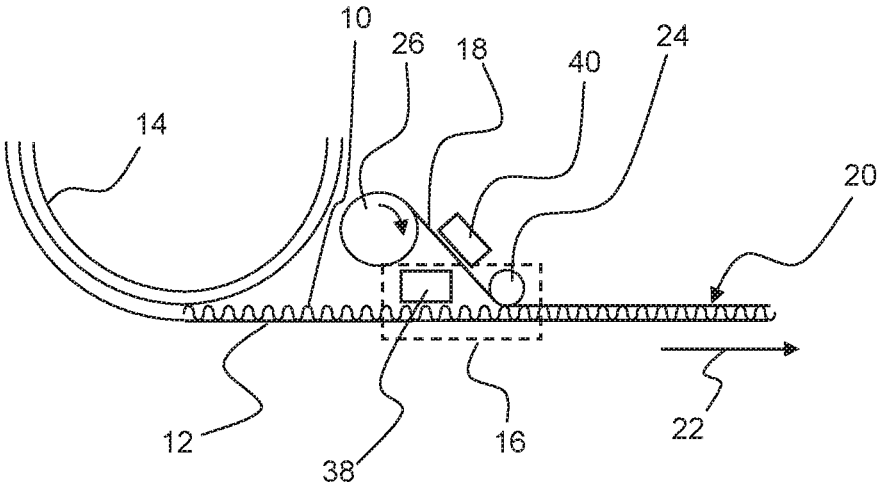
FIG. 4 shows very schematically a fourth embodiment of the invention.

FIG. 4 shows an apparatus, in which the joining station 16 also comprises an activation unit 38, which, depending on the type of adhesive substance used, may be provided before or after the corrugated layer 10 comes into contact with the second flat layer 18. Again, the joining station may or may not comprise a pair of pressing rollers. For certain applications, it may be advantageous to use a type of adhesive substance provided on the corrugated layer and/or the second flat layer that has to be activated, in particular by heat via a heater for instance a radiant element, light via a light source for instance one or more light emitting diodes (e.g., ultraviolet (UV) LED), a liquid (like e.g., water) via a nozzle or dispenser, pressure via a nozzle, vacuum, plate, platen or rollers, or the like, to show adhesive properties. Accordingly, the activation unit may comprise any structure that generates one or more of heat, light, pressure and/or for spraying said liquid.

While FIG. 4 shows an apparatus to activate an adhesive substance provided on the corrugated layer, it is obvious that such substance may additionally or alternatively be also provided on the second flat layer 18, in case of which a corresponding activation unit has to be arranged accordingly.

Various embodiments are provided with a printing unit (i.e., printer, print head with or without a print platen) 40, which in the shown examples is adapted for printing on the side of the second flat layer 18 that is opposite to the side that will be brought into contact with the corrugated layer 10. It is obvious for an expert in the art that likewise a printing unit for printing on the side of the first flat layer 12, which is not in contact with the corrugated layer 10, can be provided. FIG. 1 shows an example of such printing unit 42. For certain applications, as will be described later, it is even advantageous to provide two printing units allowing to print on both, the first and the second flat layer.

The apparatus according to the various embodiments of the invention further comprises a control system (not shown) adapted for controlling the apparatus, as will be described later. The control system can comprise one or more controllers, for example one or more micro-controllers, microprocessors, application specific integrated circuits, field programmable gate arrays, and, or programmable logic controllers. The control system can comprise one or more nontransitory storage mediums, for example one or more volatile memories for instance random access memory (RAM) or registers, and, or one or more non-volatile memories for instance read only memory (ROM), FLASH memory, magnetic hard disk drives, or optical disk drives. The nontransitory storage mediums can store processor-executable instructions and, or information, executable by a processor, and which when executed by the processor cause the processor to perform various methods described herein. The one or more controllers can be communicatively coupled to the one or more nontransitory storage mediums via one or more communications channels, for example one or more buses.

One particularly advantageous use of the apparatus is allowing the customer of a web shop to create his own packaging box design. In one embodiment, this can be put in practice as follows: When the customer finishes the order, he is asked if he wants to create an individually designed box. When the customer affirms this, in a first act the control system obtains information on the dimensions of a packing box necessary for packaging the item(s) ordered. It should be noted that the term "control system" as used herein has a broad meaning and is not limited to a single unit; rather, a control system in the sense of the embodiments of the invention will typically be comprised of different units such as processors and data bases at different locations that, may be communicatively coupled to one another, to perform different tasks in creating the customized box.

Obtaining information on the dimensions of a packaging box for the respective order can be done in multiple ways, for example by obtaining the dimensions of each item in the order from a data base. If the order contains multiple items, the control system may calculate different arrangements of the items which are optimized under different criteria as known in the art of creating customized boxes. For example, the items may be arranged to allow a box having minimal volume, minimal surface (hence reducing the amount of cardboard needed for creating the box), maximum protection and others. The machine used for forming the packaging box may only allow creating a certain number of different sized boxes, such as a small, a medium and a large box, may allow creating boxes that are adjustable in one or two dimensions such as height or width, or may allow creating boxes that are fully customized in all three dimensions, only limited by the width of the cardboard used and of course certain stability restrictions.

Figure 5:
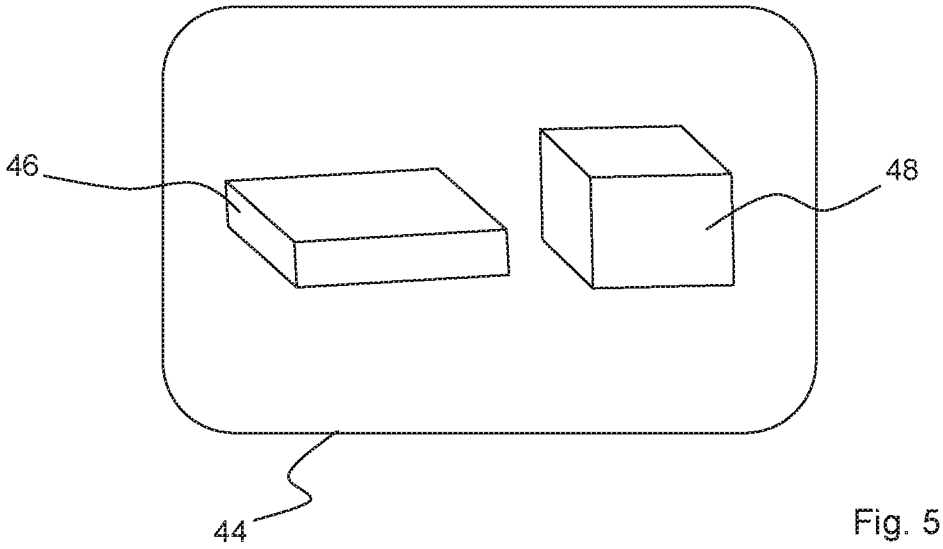
FIG. 5 shows virtual images of two different box layouts for being selected by an operator or a customer.

In the example described herein, it is assumed that the items ordered by the customer could be packaged either in rather flat arrangement or a more compact arrangement. As schematically depicted in FIG. 5, a virtual digital image 44 of two different box layouts 46 and 48 is produced and provided to the customer, so that he may choose one of the layouts 46 and 48. If the items ordered are for example wine bottles and the order is a present, the customer may prefer layout 46, in which the bottles will be packaged lying next to each other, so that the recipient of the present will see all bottles nicely arrangement opening the box. If the order is not a present, the customer may prefer box layout 48, in which the bottles would be standing next to each other and which package may be more compact, hence reducing shipment costs and/or costs of producing the box. Information on shipping costs, production costs etc. for different box layouts may of course be provided to the customer, preferably directly in the digital image 44.

Figure 6:
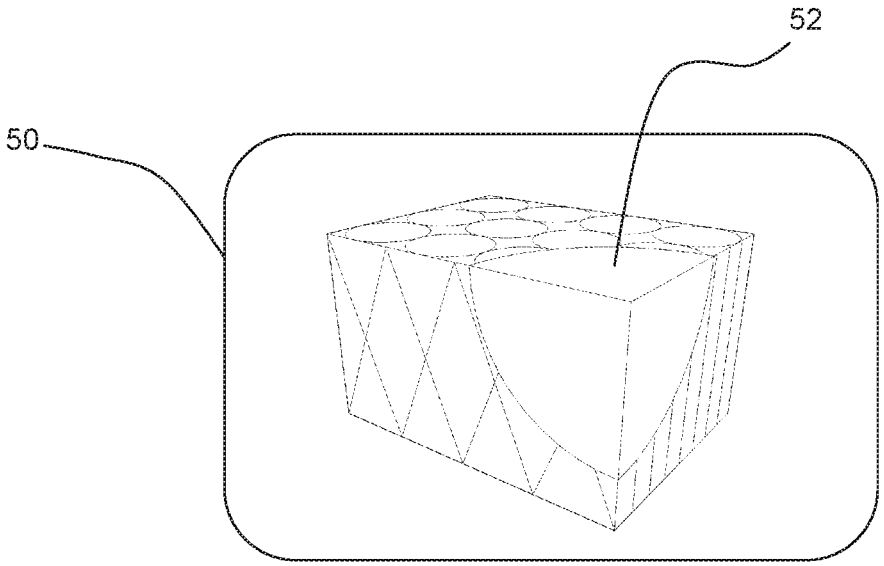
FIG. 6 shows a virtual image of a box having a selected design.

The customer may then select a design for the chosen box layout, and the control system then matches the chosen design to the box layout and produces, as schematically depicted in FIG. 6, a virtual digital image 50 showing the customer how the box 52 with the chosen design matched to it would look. If the system upon matching the design to the box layout determines that a different box layout may be better suited for the selected design, a respective message may be displayed to the customer and he may for example be asked to confirm changing the layout or keeping the chosen layout. It should be noted that as used herein the term "box layout" refers to the general cut and type of the box and includes information like dimensions of the finished box, if it is a box with an attached lid or with a separate lid, whether the intended opening of the box is done on the top or on a lateral side of the box, and how stable the box is (stability can in particular be influenced by the amount of overlap of the respective panels forming the box). The layout also defines, which panels will have fold lines and which panels will receive adhesive tape for closing the box, if such tape is used. The term "design" as used herein refers to the printing on the outer and/or inner side of the box and includes in particular a certain pattern, photographs, logos, fields for writing address information and/or attaching postage, printed address information on recipient and/or sender, printed postage, spaces for showing where sealing tape should best be attached (in particular if the boxes are to be closed by hand) etc. The term "matching" as used herein refers to adapting a selected design in particular to the dimensions of the box and other particularities of the chosen box layout, i.e. whether or not the box has a separate lid and on which side the box is closed etc. As is obvious for an expert, matching is far more than simply scaling, as photos and logos may simply be enlarged or reduced whereas certain patterns may not be adapted in size but may be applied over the respective surface and spaces for writing address information and/or for adding postage may for example always have the same size but may be placed at different locations on different packages, taking into account respective requirements of organizations handling the transport of the box to a recipient. The user of the invention may allow the customer to place certain pictures and/or fields like address information fields freely on the box, or it may be foreseen that for example address information is always placed on a certain area of a box like the lower left corner of the top etc. Obviously, in case the customer does not like the virtual digital image 50 of the box 52 with the chosen design matched to it, he could choose another design and/or another box layout, for example a more flat box like box 46 shown in FIG. 5. Moreover, via a graphical editor the customer can individually create, adapt or change a graphic design of the packaging box in line with the respective dimensions of the box.

Selecting a design can be done in multiple ways. For example, the control system may suggest certain box designs based on prior orders of the customers and/or on the dimensions and the layout of the box and the user may simply select one of the suggested designs. In a preferred embodiment, the process of selecting a design includes an act in which the customer can create his own individual design, for example by choosing certain design elements like pictures, patterns etc. from a database made available to him and/or by uploading his own design elements like in particular pictures, which will then be matched to the box layout and a virtual digital image showing how the box with the design would look could be presented to the customer, who may then select the design or start creating a different design. It is of course possible to allow selecting different designs for different parts of the box and to provide that for example large pictures extend over different sides of the box.

Whereas in the descripted embodiment a customer of a web shop selects the design, it is of course also possible that the control system automatically selects a certain design based on order information. For example, if the apparatus according to the invention is used in the process of drop shipment, the control system may automatically choose a specific design.

If the process of selecting a design and matching it to the box is finished, i.e. if the customer has accepted a certain design, the matched design is printed on the first or the second flat layer or on both. As schematically indicated in FIG. 1, an apparatus according to at least one embodiment of the invention may comprise a second printing unit 42, in the shown example arranged after the joining station 16 for attaching a second flat layer 18 to the corrugated layer 10. The printing unit could also be arranged upstream of the joining station, so that printing could be done prior to attaching the second flat layer to the corrugated layer. Likewise as indicated by the dashed box 40' in FIG. 2, the printing unit 40 could also be arranged downstream of the joining station 16. Where the printing units 40, 40' and 42 are located also depends on whether the printed design shall be on the outside of a folded box, on the inside of the box or on both, the inside and the outside. While in most cases printing on the outside may be preferred, in particular when the box holds a gift printing on the inside could be very interesting and could give the gift a very personal touch while the outside of the box is kept neutral.

As a blank, sometimes also called piano, for folding the selected box from the cardboard produced will be cut, it is also possible to arrange the printing unit downstream of such cutting stations. The inventive concept remains unchanged. In FIGS. 7-12 different blank layouts and boxes folded therefrom are shown, all leading to a box having the same general appearance like the box 52 presented in the virtual image 50 (FIG. 6), while having totally different properties.

Figure 7:
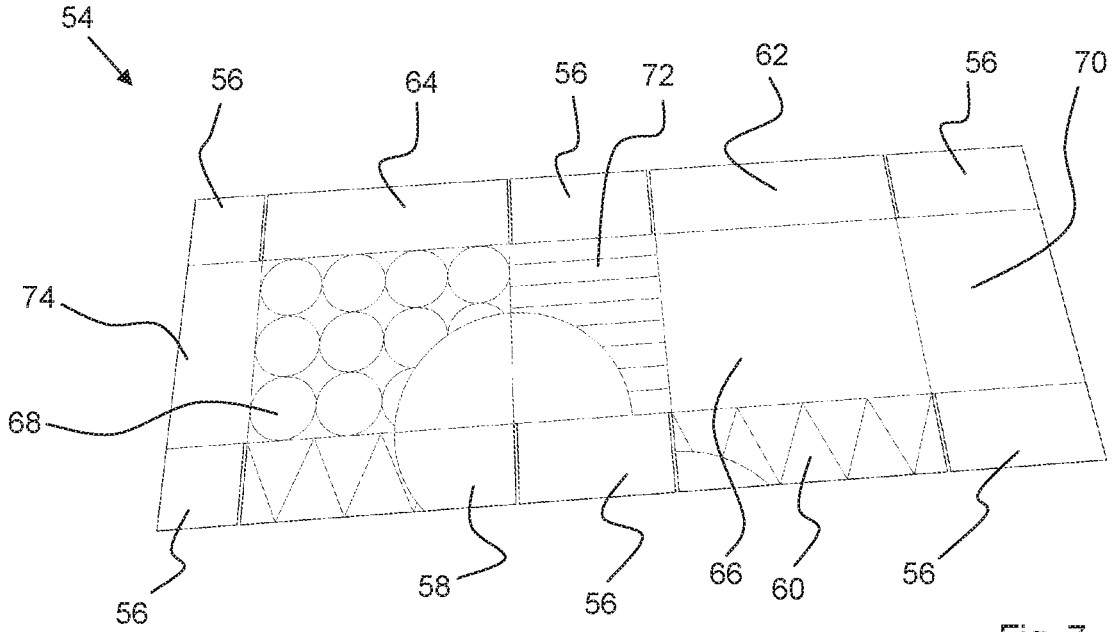
FIG. 7 shows a first blank for forming a box having the selected design.

For explanatory reasons, the three sides of the boxes shown in FIGS. 6, 8, 10 and 12 that are not fully visible in these figures are not provided with any printing, although they obviously could also be provided with such printing. Hence, the respective panels of the blanks shown in FIGS. 7, 9 and 11 are shown without any printing. Furthermore, for explanatory reasons only a certain pattern is shown as the design, while in practice fields for adding address and/or postage information etc. and/or printed information on the sender and/or the contents may also be foreseen.

Figure 8:
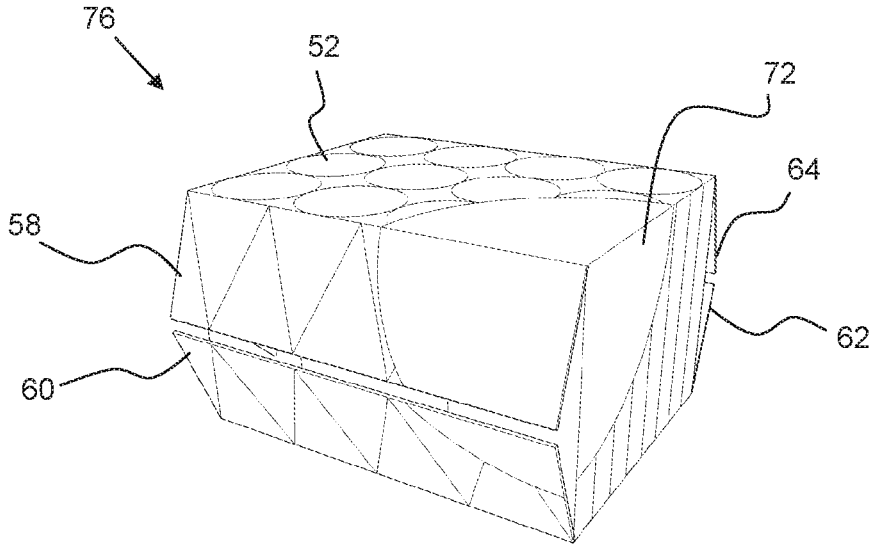
FIG. 8 shows a (not yet fully closed) box formed from the blank shown in FIG. 7.
Figure 9:
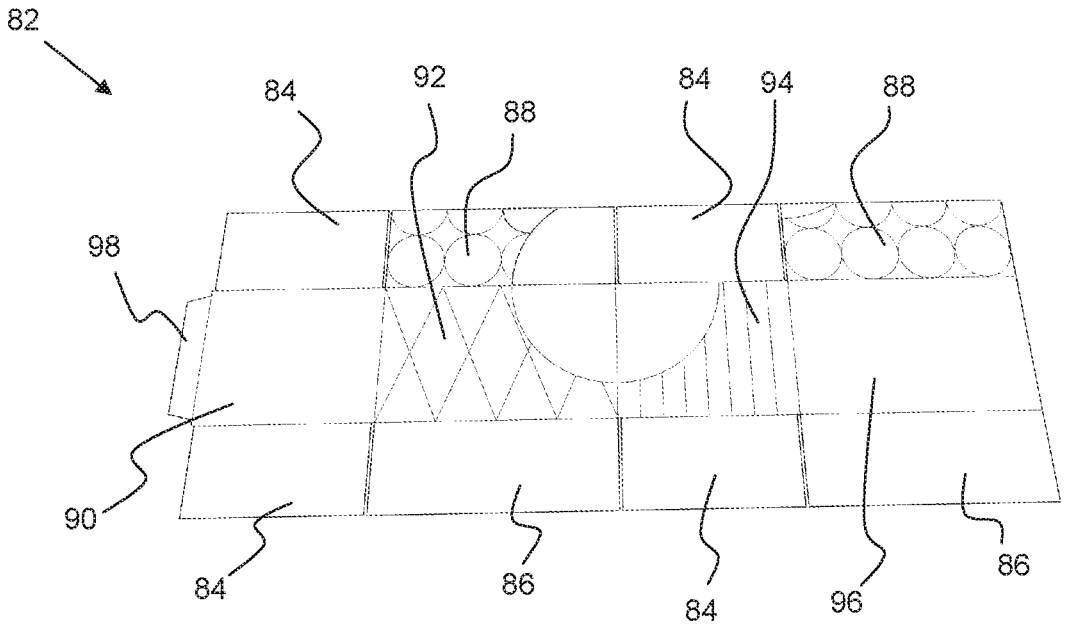
FIG. 9 shows a second blank for forming a box having the selected design.

The blank 54 shown in FIG. 7 comprises six corner panels 56, four side panels 58, 60, 62 and 64, a bottom panel 66, a top panel 68, a front end panel 70, a back end panel 72 and a top end panel 74, of which the top panel 68, the back end panel 72 and the side panels 58 and 60 are provides with a printing forming the chosen design when the panel is folded to form a box 76 as shown in FIG. 8.

Figure 10:
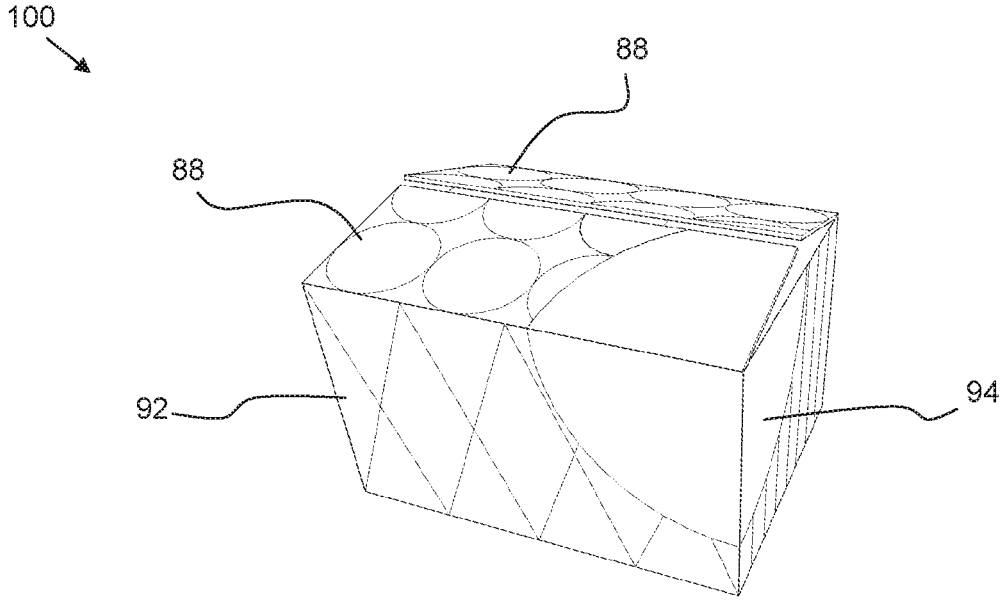
FIG. 10 shows a (not yet fully closed) box formed from the blank shown in FIG. 9.
Figure 11:
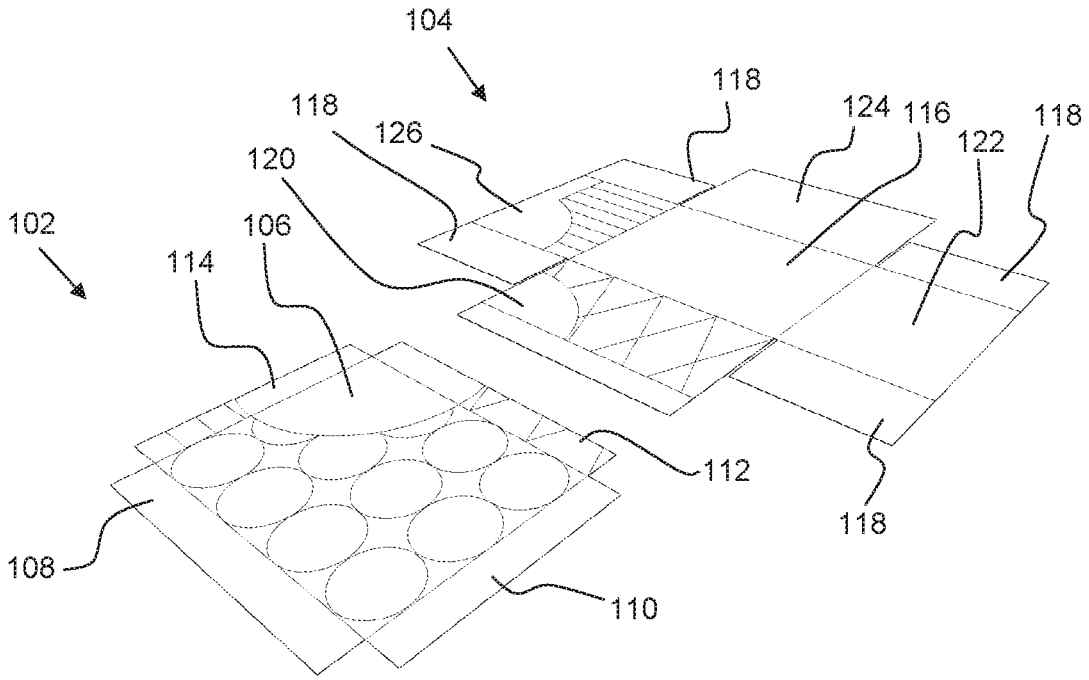
FIG. 11 shows a third blank for forming a box having the selected design.

FIG. 9 shows a different type of blank 82, which comprises four corner panels 84, two bottom panel 86, two top panels 88, four side panels 90, 92, 94, 96 and a gluing flap 98 used for attaching side panel 90 to side panel 96 upon folding a box 100 as shown in FIG. 10 from blank 82.

Figure 12:
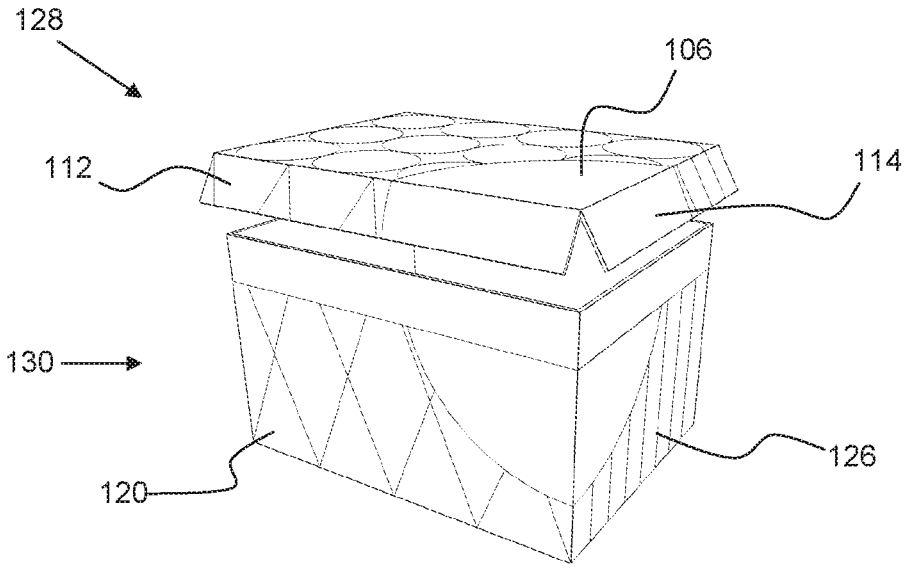
FIG. 12 shows a (not yet fully closed) box formed from the blank shown in FIG. 11.

FIG. 11 shows two blanks, namely a lid blank 102 and a box blank 104. Lid blank 102 comprises a top panel 106 and four side panels 108, 110, 112 and 114. Box blank 104 comprises a bottom panel 116, four corner panels 118 and four side panels 120, 122, 124 and 126. Lid blank 102 and box blank 104 are folded to form a lid 128 respectively a box 130 as shown in FIG. 12.

In a further embodiment of a machine for creating customized boxes, obtaining information about the dimensions of a packaging box for the respective order may also comprise allowing a customer some freedom to enlarge the packaging box if that better suites the customer created packaging design. For example, a certain dimensional tolerance (length and/or width and/or height) could be provided which can be chosen by the customer to enlarge the dimensions of the packaging box to be created in that it better matches with the design which the customer wants to create. Such dimensional tolerances could be foreseen providing that (i) the proposed boxes still can be created by said machine for creating customized boxes, (ii) the dimensions of the proposed boxes are still within the range of boxes that can be created from the cardboard used for creating packaging boxes and (iii) the dimensions of the proposed boxes do not compromise the stability restrictions of the box. A consequence of allowing an increased size of said packaging box is that there will be more empty space in the box, which may require adding fill material to the box when it is created.

The invention advantageously allows both, the operator of a respective apparatus for creating cardboard as well as the customer of such operator, to design the cardboard on demand so that a box folded from the respective cardboard will have a certain appearance. When the customer is enabled to send his own patterns, pictures, etc. to be used in the design of the box, it could be foreseen that a copyright and/or morality check is automatically performed prior to accepting a design for printing. When the operator or the customer has chosen a certain layout for a box for a specific assembly of items, it may be foreseen that packaging instructions are produced and provided together with the cardboard to a packer arranging the items to be packaged in the box. Such instructions may for example be automatically displayed on a monitor at a station where the items are packaged in the box. Likewise, in case a box with a separate lid is used, instructions on how to arrange the lid on the box may be automatically produced and provided to a person closing the box, or an indication mark on the inside of the lid and/or the box showing how the lid has to be placed on the box may be printed on the cardboard.

LIST OF REFERENCE NUMBERS

10 corrugated layer
12 first flat layer
14 roll of first layer material
16 joining station
18 second flat layer
20 corrugated cardboard
22 direction of movement of cardboard
24 pressing and transporting roller
26 roll of second layer material
28 protective layer
30 roll for used protective layer
32 means for supplying removed protective layer
34 pressing roller
36 pressing roller
38 activation unit
40, 40' printing unit
42 printing unit
44 digital image
46 box
48 box
50 digital image
52 box
54 blank
56 corner panel
58 side panel
60 side panel
62 side panel
64 side panel
66 bottom panel
68 top panel
70 front end panel
72 back end panel
74 top end panel
76 box
82 blank
84 corner panel
86 bottom panel
88 top panel
90 side panel
92 side panel
94 side panel
96 side panel
98 gluing flap
100 box
102 lid blank
104 box blank
106 top panel
108 side panel
110 side panel
112 side panel
114 side panel
116 bottom panel
118 corner panel
120 side panel
122 side panel
124 side panel
126 side panel
128 lid
130 box

The invention claimed is:

1. A method for creating on demand customized cardboard for forming individually designed packaging boxes, said cardboard having at least one corrugated layer between two flat layers, the method comprising providing a corrugated layer attached to a first flat layer, attaching a second flat layer to the corrugated layer such that the corrugated layer is sandwiched between the first and the second flat layers, obtaining information on the dimensions of a packaging box to be formed, selecting a box layout among different box layouts suitable for holding items to be packaged in the box to be formed, selecting a design to be printed on the box, the design including a plurality of discrete elements, including at least one element of the selected design which will extend across at least two different sides of the box and at least one fold line between the at least two different sides, the plurality of discrete elements including at least one of: a pattern, a photograph, a logo, a field for writing address information, a field for attaching postage, printed address information of a recipient, printed address information of a sender, printed postage, or one or more spaces showing where sealing tape is to be attached, remapping the selected design to the dimensions of the box including respective dimensions and an arrangement of two or more panels of the box to cause at least one of the plurality of discrete elements to appear at a location that crosses two or more panels of the box and at least one fold line between the two or more panels when the remapped design is printed on a blank for the box and the blank is subsequently folded into the box that is different from a location at which the at least one of the plurality of discrete elements would otherwise appear without the selected design being remapped, and printing the remapped design on the first and/or on the second flat layer of the blank for the box, wherein obtaining information on the dimensions of a packaging box to be formed includes retrieving information on items to be packaged in the box to be formed, calculating at least one optimized possible arrangement of the items, and providing a tolerance for enlarging said dimensions, wherein remapping the selected design to the dimensions of the box includes remapping the selected design to the obtained dimensions of the box with said enlarging.

2. The method according to claim 1, wherein selecting a design includes receiving a digital image for being used in the design of the box.

3. The method according to claim 1, wherein selecting a design includes creating a customized graphic design in line with the obtained dimensions.

4. The method according to claim 1, wherein selecting a box layout comprises selecting one of a box having fixed dimensions, a box having one or two adjustable dimensions, and a box having fully customized dimensions.

5. The method according to claim 1, further comprising producing packaging instructions for arranging the items to be packaged in the box to be formed.

6. The method according to claim 1, wherein remapping the design to the dimensions of the box includes calculating positions of address and postage information and/or of sealing tape used for sealing the box formed and/or of fold lines present on the box.

7. The method according to claim 1, further comprising producing a virtual digital image of a box having the selected design prior to printing the design.

8. The method according to claim 1, wherein remapping the selected design to the dimensions of the box including respective dimensions and an arrangement of two or more panels of the box causes at least one of: the pattern, the photograph, the logo, the field for writing address information, the field for attaching postage, the printed address information of the recipient, the printed address information of the sender, the printed postage, or one or more spaces showing where sealing tape is to be attached of the remapped design to appear on or across different ones of the two or more panels of the box when the remapped design is printed on a blank for the box and the blank is subsequently folded into the box than the two or more panels of the box on which the at least one of: the pattern, the photograph, the logo, the field for writing address information, the field for attaching postage, the printed address information of the recipient, the printed address information of the sender, the printed postage, or the one or more spaces showing where sealing tape is to be attached of the selected design would otherwise appear without the selected design being remapped.

9. The method according to claim 1 wherein the remapped design is printed on the first and/or on the second flat layer of the blank for the box after the corrugated layer attached is attached to the first flat layer and the second flat layer.

* * * * *